US007820945B2

(12) United States Patent
Seo

(10) Patent No.: US 7,820,945 B2
(45) Date of Patent: Oct. 26, 2010

(54) HEATING FABRIC AND MANUFACTURING METHOD THEREOF

(75) Inventor: Young Cheol Seo, Seoul (KR)

(73) Assignee: Pacific Medical Co., Ltd., Seoul (KR)

( * ) Notice: Subject to any disclaimer, the term of this patent is extended or adjusted under 35 U.S.C. 154(b) by 300 days.

(21) Appl. No.: 11/908,209

(22) PCT Filed: Nov. 15, 2005

(86) PCT No.: PCT/KR2005/003858

§ 371 (c)(1),
(2), (4) Date: Oct. 23, 2007

(87) PCT Pub. No.: WO2006/054853

PCT Pub. Date: May 26, 2006

(65) Prior Publication Data

US 2008/0135120 A1 Jun. 12, 2008

(30) Foreign Application Priority Data

Nov. 22, 2004 (KR) ..... 20-2004-0033019 U
Dec. 14, 2004 (KR) ..... 10-2004-0105320

(51) Int. Cl.
*H05B 3/36* (2006.01)
*H05B 3/56* (2006.01)

(52) U.S. Cl. ..... 219/212; 442/117; 442/189; 442/199; 442/203; 442/218; 442/220; 442/228; 442/229; 442/286; 28/100; 28/140; 28/143; 28/149; 28/151

(58) Field of Classification Search ..... 219/212; 442/117, 189, 199, 203, 218, 220, 228, 229, 442/286; 28/100, 140, 143, 149, 151
See application file for complete search history.

(56) References Cited

OTHER PUBLICATIONS

International Search Report for PCT/KR2005/003858 mailed Feb. 24, 2006, one page.

*Primary Examiner*—Andrew T Piziali
(74) *Attorney, Agent, or Firm*—Rankin, Hill & Clark LLP

(57) ABSTRACT

Disclosed is a heating fabric comprising a heating fabric element made by weaving woof fibers and warp fibers, a pair of conductive parts being a plain fabric made by a weaving method to extend from one side edge of the heating fabric element, for supplying electric power to the heating fabric element, wherein electrode fibers are woven in rows as warp threads in the conductive parts and a heating fiber is intermittently woven as woof threads at predetermined intervals so as to be conductive with the conductive parts, and wherein the heating fiber is woven in a zigzag pattern on the other side of the plain fabric of the conductive parts, in which one end of the heating fiber is woven into the conductive part, and a portion of the other end of the heating fiber is not woven into the conductive part, thereby forming a jumping portion having a length longer than a width of the conductive part, the jumping portion jumping over the conductive part so as not to be conductive with the conductive part. Due to the one-side arrangement of the conductive parts and the zigzag pattern of the carbon fibers, electromagnetic waves are reduced and offset. Accordingly, the heating fabric is advantageous for a user's health.

12 Claims, 9 Drawing Sheets

[Fig. 1]
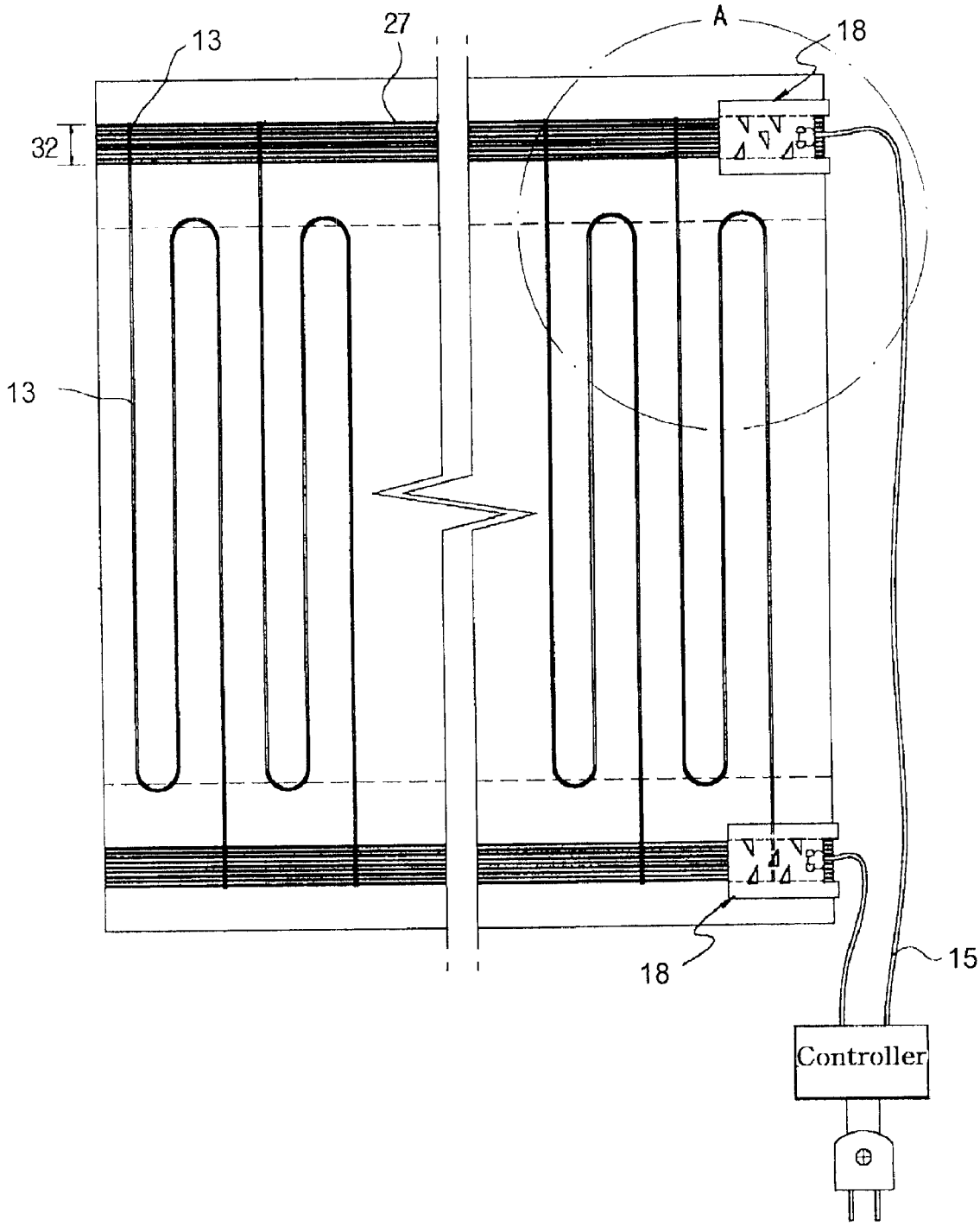

[Fig. 2]
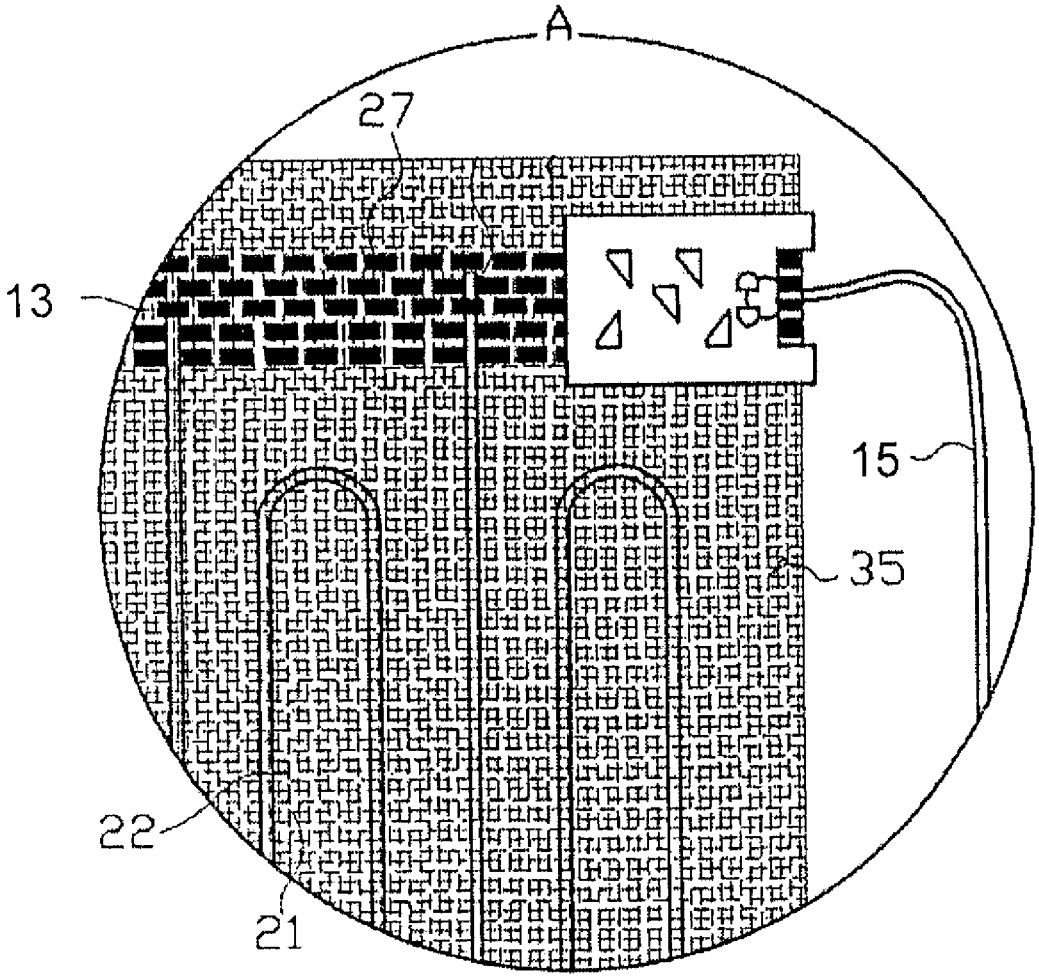

[Fig. 3]
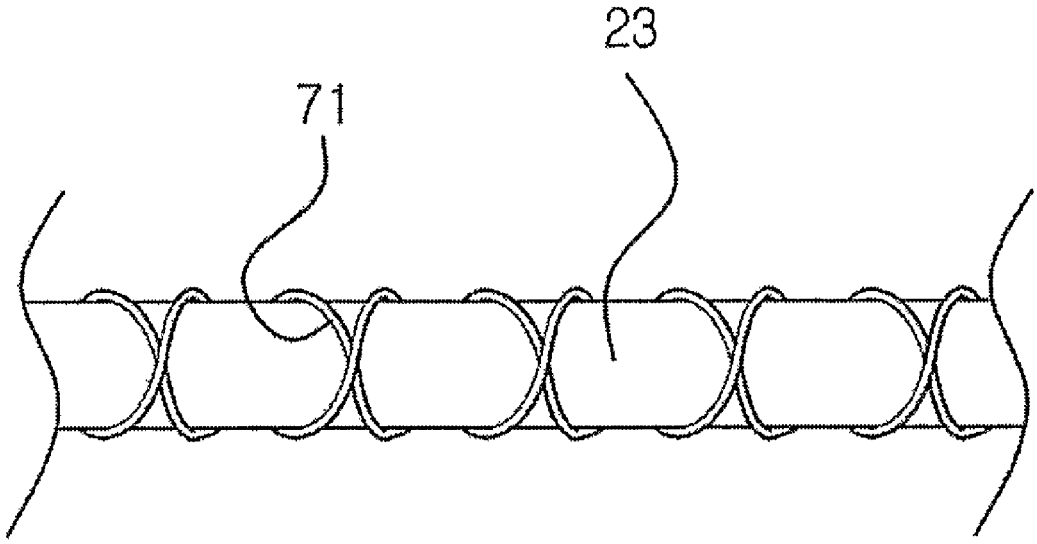

[Fig. 4]
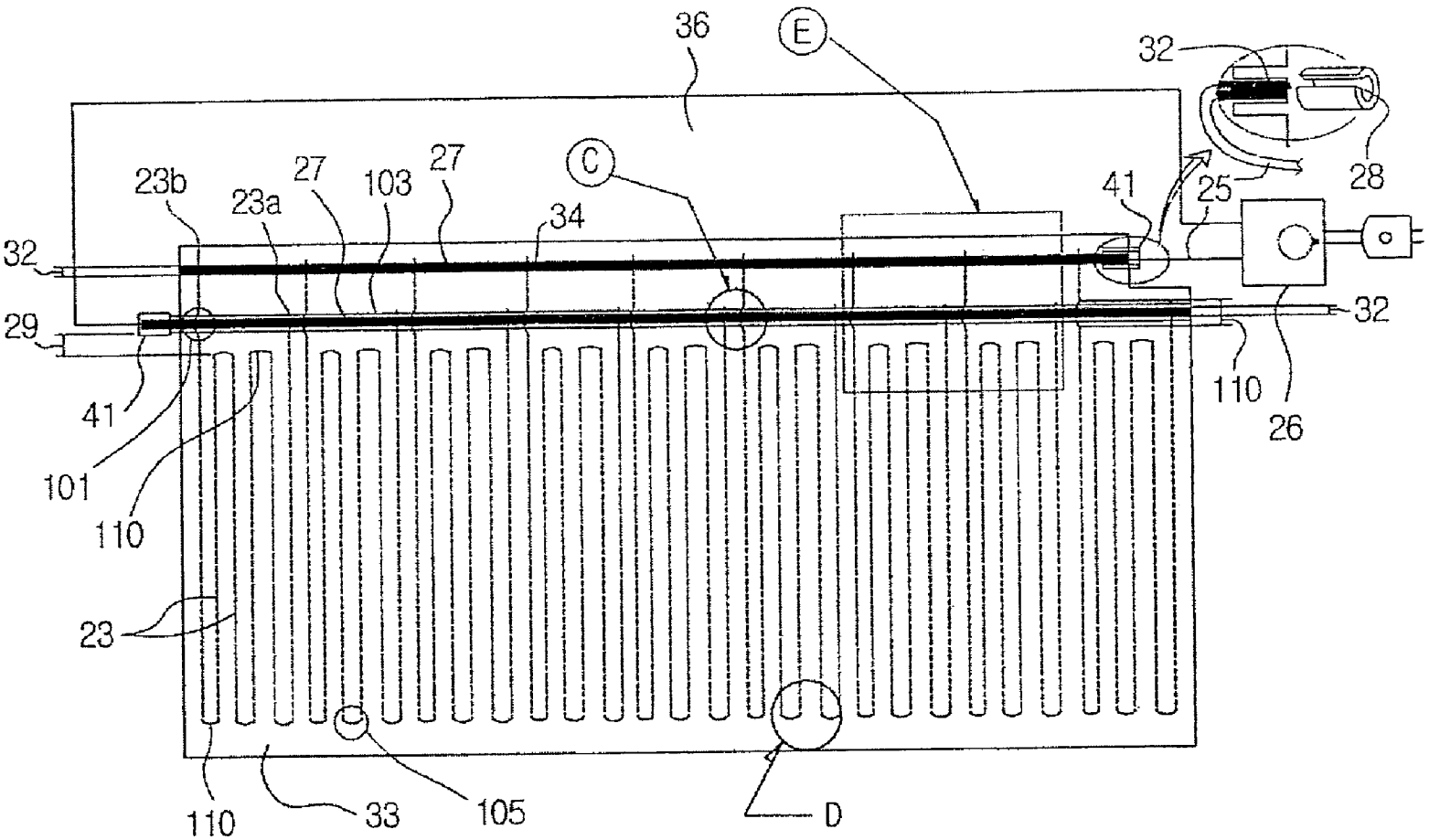

[Fig. 5]
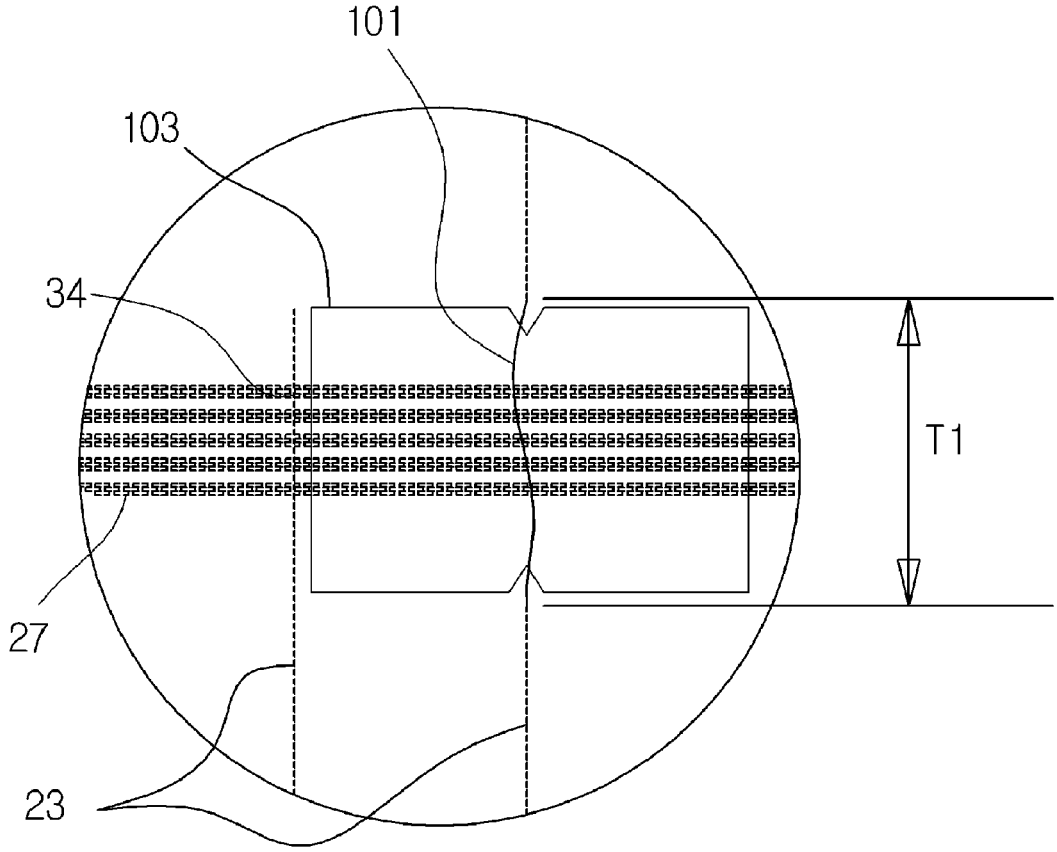

[Fig. 6]
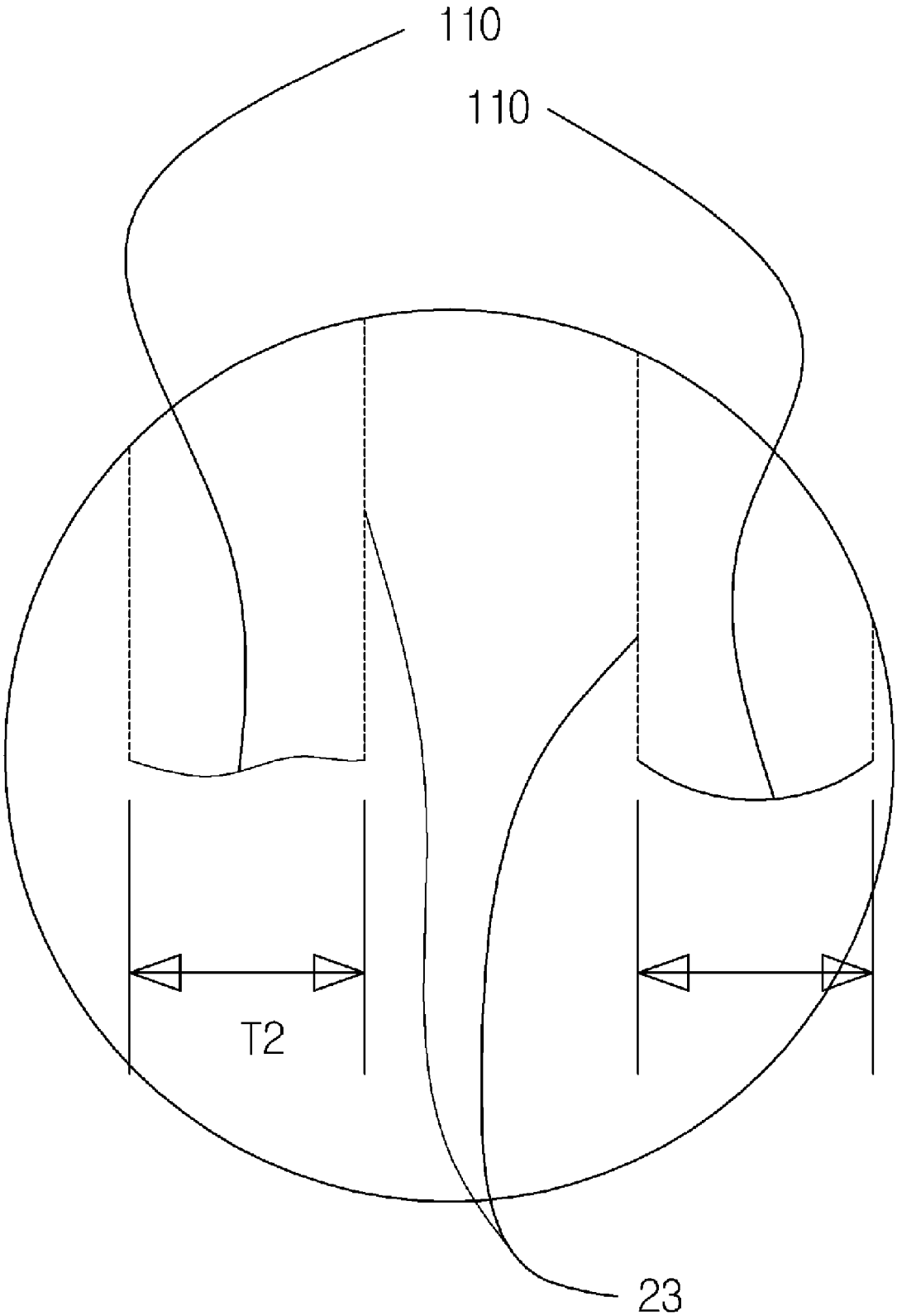

[Fig. 7]
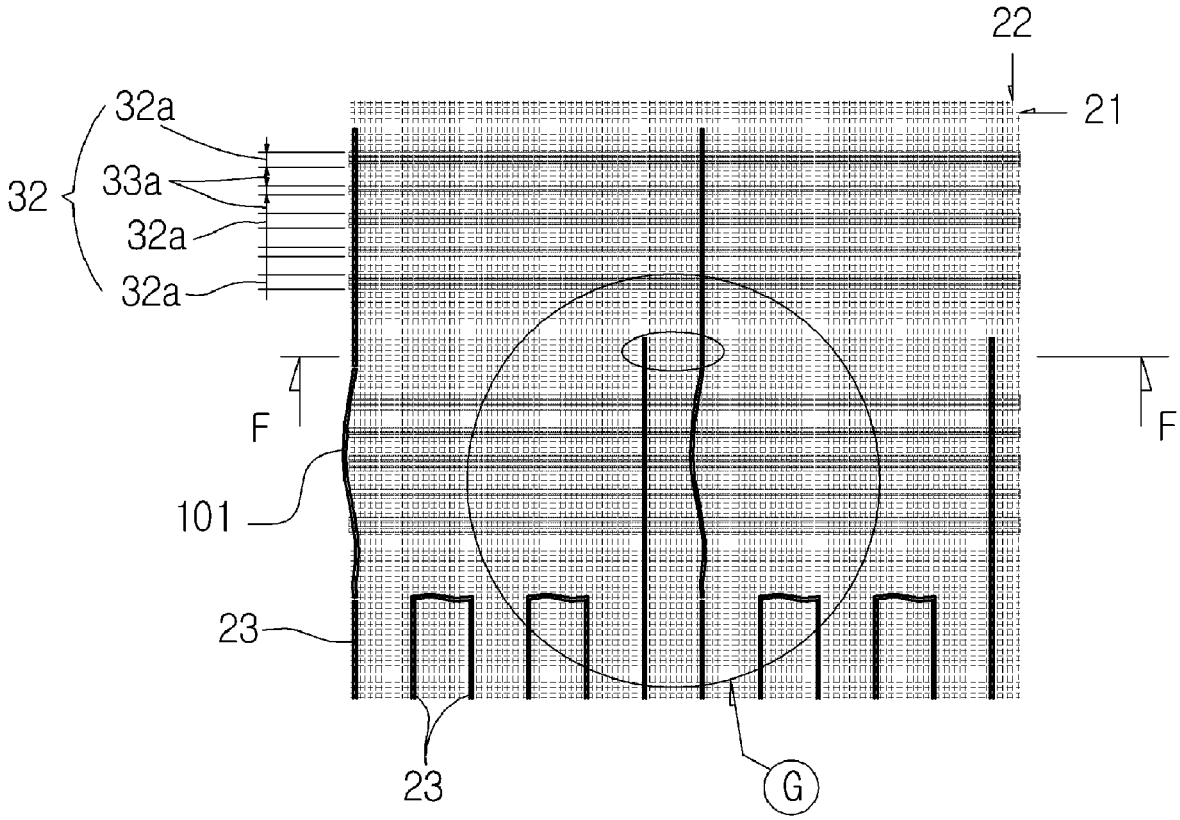

[Fig. 8]
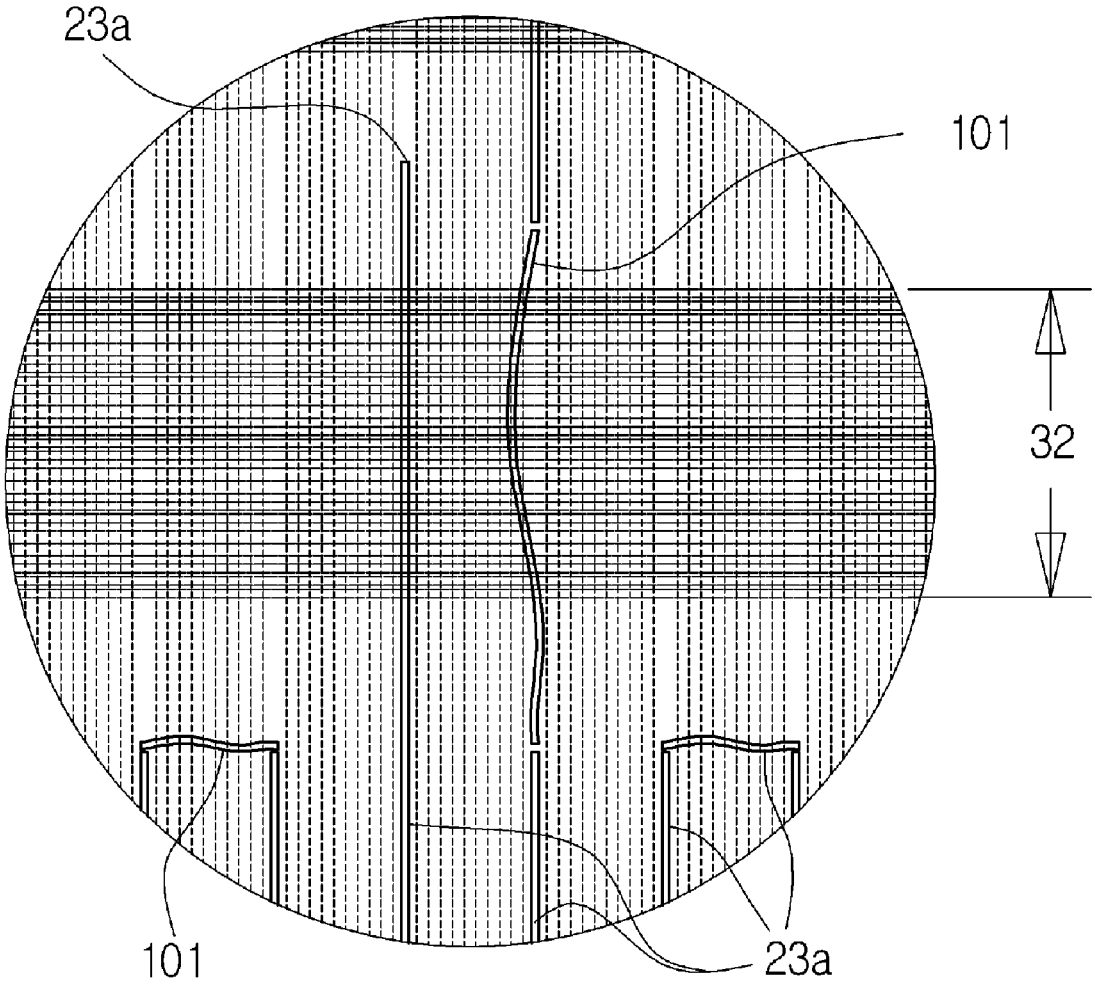

[Fig. 9]
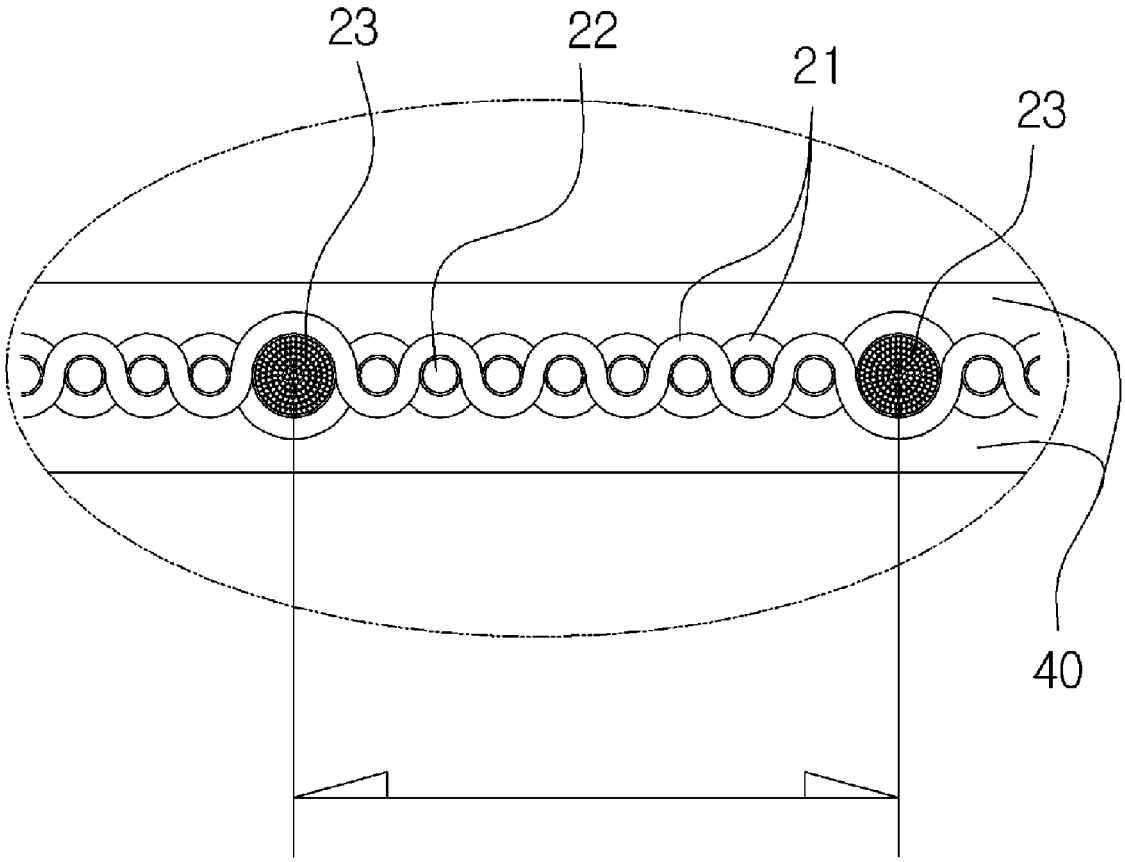

HEATING FABRIC AND MANUFACTURING METHOD THEREOF

TECHNICAL FIELD

The present invention relates to a heating fabric and a method of manufacturing the same. More particularly, the present invention relates to a heating fabric having a conductive part provided at a side edge of a heating fabric element made by weaving fibers as woof threads and warp threads for supplying electric power to the heating fabric element, in which the conductive part is made by weaving tin-plated wires as woof threads and regular fibers as warp threads, and a method of manufacturing the heating fabric.

BACKGROUND ART

Generally, a film heater is made by two methods. According to one method, a conductive material, such as carbon, having a predetermined resistance, is coated on an insulator in a predetermined pattern, so that the heater generates heat by applying a current to the conductive pattern. According to the other method, an electrically resistive wire, such as carbon wire or nichrome wire, is mixed as woof threads or warp threads when weaving a fabric using fibers, thereby producing a heating fabric element, so that the heating fabric element generates heat by applying a current to the electrically resistive wire.

A heating fabric having a heating fabric element is shown in FIGS. 1 and 2. Referring to FIG. 1, the heating fabric comprises a fabric made by weaving regular fibers, such as natural fibers or synthetic fibers 35, as woof threads 21 and warp threads 22, close to each other, a heating fiber 13, such as carbon fiber, arranged in the fabric at predetermined intervals, as warp threads 22, and a metal fiber 27 woven to extend from both side edges of the fabric as warp threads 22. Further, a power line 15 is connected to one edge of the woven metal fiber 27 to supply electric power to the fabric. The carbon fibers and the nichrome wires used generally in the heating fabric as the metal fibers are not easily fused and attached to lead used as the power line 15. Accordingly, the conductive part 32 made of the metal fibers 27 is connected to the power line 15 by using a double-side press terminal 18 which is in contact with both sides of the conductive part 32 and pressed against the conductive part 32 from both sides of the conductive part 32.

By the connection method using the double-side press terminal, current conduction can be easily caused between the power line and the conductive part, which is made by weaving metal fibers. However, the connection method using the double-side press terminal also has the disadvantage of a short circuit, which can easily occur due to the press. Accordingly, even though the terminal is compressed, the connection is not always successful, so that contact resistance at the contact portion between the conductive part and the power line increases. As a result, the heating fibers are separated from the press terminal and a short circuit is caused at the side edges of the terminal due to the press applied to the press terminal, so that the function of the heating fabric can not be properly performed and product failure is caused, resulting in degradation of the product reliability and increase in after-service demands.

Further, in the case in which the power line 15 is connected to the heating fiber 27 in parallel, since contact points to be connected in parallel are connected by an electric wire, such as heat resistant wire, the productivity of electronic heaters using a heating fabric element, such as an electronic heating pad or an electronic heating mat, is lowered, and emission of electromagnetic wave is increased since the direction of current flows in the two adjacent electric wire groups are the same.

DISCLOSURE OF INVENTION

Technical Problem

Accordingly, the present invention has been made keeping in mind the above problems occurring in the prior art, and an object of the present invention is to provide a heating fabric comprising a heating fabric element in which a fabric is made by weaving fibers as woof threads and warp threads, in which some portion of the fabric is made by weaving using a heating fiber as woof threads or warp threads, the heating fiber is arranged at a peripheral portion of the fabric, and a distance between both ends of the heating fiber is the same as a length of the woof thread or the warp thread, wherein both side end portions with a predetermined width in the fabric are woven with electrode metal fibers, such as tin-plated copper wire having high electrical conductivity, silver wire, or aluminum wire, the metal fibers being one of two or more strands of woof thread or warp thread, and a power line connected to one end of the fabric.

The metal fibers, the electrode fibers, are woven at a side end portion of the fabric to have a predetermined width, one end of each of the heating fibers are woven together with the fabric in a portion woven by using the metal fibers, so that the heating fibers are connected to the fabric woven by using the metal fibers in parallel. As a result, short circuit between the heating fiber and the power line or between the heating fibers, contact failure and amplification of electromagnetic wave can be inhibited, the productivity is increased due to the simplified manufacturing process, and the reliability of the products is enhanced.

Technical Solution

In order to achieve the above object, according to one aspect of the present invention, there is provided a heating fabric comprising a heating fabric element which is made by weaving fibers as woof threads and warp threads, a pair of conductive parts provided at a side edge of the heating fabric element and made by weaving a plurality of electrode fibers in a plain fabric in which the electrode fibers are arranged in rows in the direction of the warp fibers, for supplying electric power to the heating fabric element, a heating fiber woven on the other side of the plain fabric in a zigzag pattern at predetermined intervals as it is mixed with the fibers, wherein one end of the heating fiber is woven with one conductive part of the pair of conductive parts so as to be electrically connected to a power line coupled to the conductive part, and the other end of the heating fiber is electrically connected to the other conductive part of the pair of conductive parts while it is not connected to the conductive part by having a jumping portion having a length longer than a width of the conductive part, the jumping portion being unwoven with the conductive part and jumping over the conductive part.

Advantageous Effects

As is apparent from the above descriptions, the heating fabric according to the present invention provides the advantages in that a heating fabric element is easily connected to a heating fiber by a conductive part made by weaving, the reliability of products is enhanced by reducing product failures, such as a short-circuited connection, the productivity is increased by simplifying the process of connecting the heating fiber and the power line, after-service costs and manufacturing costs are reduced, and the product quality is upgraded.

BRIEF DESCRIPTION OF THE DRAWINGS

FIG. 1 is a plan view illustrating a heating fabric according to a prior art;

FIG. 2 is an enlarged view of part A shown in FIG. 2;

FIG. 3 is an enlarged perspective view illustrating a heating fiber of a heating fabric according to the present invention;

FIG. 4 is a plan view illustrating a heating fabric according to one embodiment of the present invention;

FIGS. 5 to 7 are enlarged views of parts C, D and E shown in FIG. 4, for illustrating the connection and disconnection status between a conductive part and an end portion of a heating fiber in the heating fabric according to the present invention;

FIG. 8 is an enlarged view of part G shown in FIG. 7, for more precisely illustrating the connection and disconnection status between the conductive part and the end portion of the heating fiber in the heating fabric according to the present invention;

FIG. 9 is a sectional view of a tissue of a heating fiber, taken along line F-F shown in FIG. 7.

BEST MODE FOR CARRYING OUT THE INVENTION

Hereafter, a heating fabric made by consolidating a fabric which is a heating fabric element, a heating fiber and a power line, according to one embodiment of the present invention, will be described with reference to the accompanying drawings.

As shown in FIGS. 4 to 9, a heating fabric according to a first embodiment of the present invention comprises a heating fabric element 33 which is made by weaving woof threads 22 and warp threads 21, which are made of fibers 35. The fiber used in the heating fabric element 33 is a natural fiber of 4/20, polyester filament or glass yarn.

The heating fabric 20 according to the present invention is made by weaving a heating fiber 23 and fibers 35 together. In the case of using the heating fiber 23 as the warp thread 21, first the fibers 35 are woven as the warp threads 21 by 10 mm to 15 mm, and then the heating fiber 23 is continuously woven as the warp thread 21 to form a zigzag pattern.

A pair of conductive parts 32 for supplying electric power is woven in a plain fabric on a side of the heating fabric element 33, in which each conductive part is separated from each other.

In the pair of conductive parts 32, a plurality of electrode fibers 27 are arranged in a plurality of rows as warp threads, and heating fibers 23 are arranged in a plurality of rows as woof threads at predetermined intervals, in which the electrode fibers 27 and the heating fibers 23 are woven, thereby to form the conductive parts 32, so that the heating fibers 23 can be electrically connected to the pair of conductive parts 32.

The heating fibers 23 are woven with the fibers 35 on the other side of the plain fabric of the pair of conductive parts 32 at predetermined intervals, forming a zigzag pattern.

One end portion 23*a* of the heating fiber 23 is woven to be one element of one conductive part 32 of the pair of conductive parts 32.

The other end portion 23*b* of the heating fiber 23 has a jumping portion 101, which is arranged to jump over the first conductive part 32 such that the jumping portion 101 is disconnected from the conductive part 32. That is, the jumping portion 101 is unwoven in the plain fabric, and has a length T1 longer than the width T2 of the conductive part 32.

The heating fiber 23 is preferably a carbon fiber into which acryl resin in an emulsion state is impregnated by ultra sonic waves. However, electronic wires, such as nichrome wires coated with acryl-based resin, tungsten wires, or carbon wires coated with heat resistant silicon, generating heat when a current flows there through, can be used as the heating fiber 23, since it is possible to offset electromagnetic waves by alternating the current flow of the conductive wires. Accordingly, any kind of conductive wires can be used as the heating fiber 23, and the heating fiber 23 has U-turn portions 105 disposed at opposing sides of the end portions 23*a* and 23*b* at predetermined intervals, forming a zigzag pattern. The U-turn portions 105 are second jumping connection portions 110, which are unwoven portions.

Further, the heating fiber 23 comprises a bundle of carbon fibers and a plurality of synthetic fibers 71 having high resistance and winding around the bundle of carbon fibers, wherein the synthetic fibers 71 wind around the carbon fibers in the opposite direction, thereby the two intersect each other.

Still further, the heating fabric element 33 is laminated with electrically insulative resin films 40 at both sides by a thermo compression coating method.

The electrode fiber is used as a warp thread. The conductive part comprises three to five electrode fiber groups 32*a*, each including two to three electrode fiber pairs, and three to five fiber groups 33*a*, each including two to three fiber pairs. In the conductive part, the electrode fiber groups 32*a* and the fiber groups 33*a* are alternately woven.

In other words, the pair of conductive parts 32 for supplying electric power is woven on a side of the heating fabric element 33 as woof thread 22. One conductive part of the pair of conductive parts 32 comprises a connection portion 34, in which the electrode fiber 27 and an end portion 30 of the heating fiber are woven for electrically connecting the conductive part 32 to the heating fabric element 33. Further, the other conductive part 32 of the pair of conductive parts 32 has a jumping portion 101 of the heating fiber 23, in which the jumping portion is unwoven with the conductive part 32 and jumps over the conductive part 32.

Further, a stripe-type insulation member 103, such as flat vinyl or Teflon tape is attached to the unwoven jumping portion 101.

A second jumping connection portion 110 of the heating fiber 23 is provided as unwoven with the fibers 35 between the heating fiber 23 and an adjacent heating fiber and disposed at the opposing side of the end portions of the heating fiber 23.

The heating portion 33 is formed by weaving the heating fiber 23 as woof thread and fibers 35 as warp thread 21. In the jumping portion 101 extending from the heating portion 33, only fibers are woven. The conductive parts 32 are formed by weaving the electrode fibers 27, such as copper wires, tin-plated copper wires, silver wires or aluminum wires, as woof threads.

An edge 36 of a fabric extending from the conductive part 32 is made by weaving only fibers like the heating portion 33, except for the heating fiber 23, and in particular by a conventional rug end treatment method in order to prevent unknitting.

The end portion 30 of the heating fiber 23 is woven as warp thread when weaving a space part 29 and the conductive part 32, thereby electrically connecting the conductive part 32 to the heating portion 33. A diameter of the electrode fiber, which is the heating fiber, is determined based on the characteristic of a final product and design parameters, but preferably is about 0.08 mm from the viewpoint of the convenience of weaving work.

In order to enhance the convenience of weaving work and the mechanical characteristics, such as tensile strength, the outer surface of the heating fiber 23 is wound by a thread 71, such as polyester fiber or cotton fiber. In this instance, thickness of the thread winding around the heating fiber 23 is determined based on the diameter of the electrode fiber, and the winding thread is preferably thinner than the electrode fiber. Further, the end portion 30 of the heating fiber, the portion being connected to the conductive part 32, is not wound by the thread.

In order to supply electric power to the heating fabric element made by a weaving manner described above, as shown in FIG. 4, the connection between the conductive parts 32 and the power line 25 are made by using a cylinder shape press terminal 28 having a cut-away opening formed along the length. In the heating fabric element, both the top and bottom of the conductive part 32 are cut away, and the press terminal 28 is inserted into the cut-away portions of the fabric so that one end of the conductive part 32 is inserted inside the press terminal 28 and fixed therein. Further, the power line 25 is inserted into the inner portion of the press terminal 28 and the press terminal 28 is pressed against the power line 25 by a tool, such as terminal press device, so that the power line is connected to the conductive part 32 of the heating fabric element. Further, since the heating fiber of the heating fabric element and the conductive part 32 are connected in a woven manner, electric power is supplied to the heating fiber through the conductive part from the power line, so that the heating fiber generates heat. In order to secure the connection between the heating fiber 23 and the conductive part 32, the connected portion of the heating fiber 23 and the conductive part 32 is combined with a tubular enforced press terminal 41 having a cut-away opening formed along the length thereof, as shown in FIG. 4. The tubular-enforced press terminals 41 are engaged with the upper and lower conductive parts 32, respectively, in the opposite directions, and pressed against the conductive parts 32, resulting in a secure electrical connection. The press terminals can also be engaged with the conductive parts 32 in the same direction. A controller 26 enables control of electrical power to the heating fabric 20.

Hereinafter, a method of manufacturing the heating fabric will be described below. In the first step, the heating fiber is prepared by passing a carbon roving fiber through an acryl resin emulsion impregnation tank, which is capable of generating ultrasonic waves therein. In this instance, the heating fiber is an enforced heating fiber 23 in which a plurality of synthetic fibers 71 having high electric resistance wind around the carbon roving fiber in the opposite direction, thereby intersecting one another.

Here, the heating fiber is preferably made by coating acryl resin, which is a liquid varnish agent, on the surface of a bundle of carbon fibers, including at least 100 threads of carbon fibers. The impregnation tank opened at the top stores acryl-based liquid resin and generates ultrasonic waves of 5 KHz to 50 KHz therein, so that the cavitation is effectively caused in the tank. In particular, it is found that the carbon fiber bundle without pores or air bubbles is formed when an ultrasonic wave of 40 KHz is generated.

Further, as shown in FIG. 3, the heating fiber 23 comprises a plurality of synthetic fibers 71 having high electric resistance, which are wound in the opposite direction around the carbon fiber bundle, to again intersect one another. Accordingly, such heating fiber 23 having the synthetic fiber windings has the enhanced tensile strength in extension, compressive strain, and flexion deformity over the conventional carbon fiber, and the tensile strength of the heating fiber of 2K cord bundle is increased to 50 kgf when the heating fiber is enforced with two strands of twisted synthetic fiber 71.

In the second step, a shuttle loom is operated to weave the heating fabric element 33 in which the heating fiber 23 is intermittently woven, having the first jumping portion 101 and the second jumping connection portion 110.

In the third step, heating fabric layers are applied on both sides of the heating fabric element 33 prepared by the above described steps, using a coating device with an impregnation tank which stores loess and acryl resin, and then the loess layers are dried.

In the fourth step, electrically insulative resin films are applied on both sides of the heating fabric element 33 by a thermo compression coating method, thereby preparing a heating fabric having enhanced flexion strength.

INDUSTRIAL APPLICABILITY

In order to use the above described heating fabric element as an electric heating element, such as electric pad or electric mat, synthetic resin coating layers can be attached onto the both sides of the heating fabric element by a thermo compression coating method, according to the characteristic of the electronic heater products. Further, since the conductive part and the zigzag pattern of the carbon fiber are arranged at a side edge portion of the heating fabric element, electromagnetic waves can be reduced and offset, so that the heating fabric is advantageous for a user's health.

Although preferred embodiments of the present invention have been described for illustrative purposes, those skilled in the art will appreciate that various modifications, additions and substitutions are possible, without departing from the scope and spirit of the invention as disclosed in the accompanying claim.

The invention claimed is:

1. A heating fabric having a heating fabric element, which is made by weaving woof fibers and warp fibers, comprising:

first and second conductive parts woven in a plain fabric are provided proximate an edge portion of the heating fabric element for supplying electric power to the heating fabric element, in which a plurality of electrode fibers are arranged in a plurality of rows as warp threads; and a heating fiber woven in the first and second conductive parts as woof threads, so as to be electrically connected with the first and second conductive parts, wherein the heating fiber is woven to form a zigzag pattern on a portion of the plain fabric adjacent to the first and second conductive parts, wherein a first end portion of the heating fiber is woven with the first conductive part, so as to be connected to a power line, which is connected to the first conductive part, wherein the second end portion of the heating fiber forms a jumping portion having a length greater than a width of the first conductive part and is arranged to jump over the first conductive part to be electrically disconnected with the first conductive part, and wherein the second end portion is electrically connected to the second conductive part.

2. The heating fabric as claimed in claim 1, wherein the heating fiber is a carbon fiber impregnated with acryl resin in an emulsion state by ultrasonic waves.

3. The heating fabric as claimed in claim 1, wherein the heating fiber is arranged in a zigzag pattern and has U-turn portions, which are disposed at opposing sides of the both ends of the heating fiber, and which form jumping connections unwoven in the fabric.

4. The heating fabric as claimed in claim 1, wherein the heating fiber is wound by a plurality of synthetic fibers in directions intersecting each other.

5. The heating fabric as claimed in claim 1, wherein electrically insulative resin films are attached on both sides of the heating fabric element by a thermo compression coating method.

6. The heating fabric as claimed in claim 1, wherein the first and second conductive parts include electrode fiber groups, each including a plurality of electrode fiber pairs, and fiber groups, each including a plurality of fiber pairs, wherein the electrode fiber groups and the fiber groups are alternately repeatedly woven a plurality of times.

7. A method of manufacturing a heating fabric in which a heating fabric element is made by weaving fibers as woof threads and warp threads, comprising the steps of:

weaving the heating fabric element; and weaving a first and second conductive parts for supplying electric power such that the first and second conductive parts extend from an edge of the heating fabric element and are woven in a plain fabric, wherein a plurality of electrode fibers are woven as warp threads in the first and second conductive parts and a heating fiber is woven in a plurality of rows in the first and second conductive parts as woof threads so that the heating fiber is electrically connected to the first and second conductive parts, wherein the heating fibers are woven on a portion of the plain fabric adjacent to the conductive parts in a zigzag pattern at predetermined intervals, wherein a first end portion of the heating fiber is woven in the first conductive part, and a second end portion of the heating fiber forms a jumping portion whereby the heating fiber jumps over the first conductive part and is electrically disconnected from the first conductive part whereby the second end portion, excluding the jumping portion, is woven.

8. The method of manufacturing the heating fabric as claimed in claim 7, wherein the heating fiber is prepared by passing carbon roving fibers wound by a carbon fiber through an acryl resin emulsion impregnation tank which is capable of generating ultrasonic waves and drying the impregnated fiber, and wherein the heating fiber is an enforced fiber in which a plurality of synthetic fibers having high electric resistance winds around the carbon roving fibers in opposite directions, to intersect each other.

9. The method of manufacturing the heating fabric as claimed in claim 7 further comprising the step of starting a shuttle loom to intermittently weave the heating fiber into the heating fabric element, while intermittently unweaving the heating fiber, thereby forming the jumping portion and jumping connections to the heating fiber.

10. The method of manufacturing the heating fabric as claimed in claim 9 further comprising the steps of:

coating loess layers on both sides of the heating fabric element using a coating apparatus having an impregnation tank which stores loess and acryl resin;

drying the loess layers; and attaching electrically insulative resin films on both sides of the heating fabric element by a thermo compression coating method, to thereby produce a heating fabric having enhanced flexion strength.

11. The heating fabric as claimed in claim 2, wherein the heating fiber is wound by a plurality of synthetic fibers in directions intersecting each other.

12. The method of manufacturing the heating fabric as claimed in claim 8 further comprising the step of starting a shuttle loom to intermittently weave the heating fiber into the heating fabric element, while intermittently unweaving the heating fiber, thereby forming the jumping portion and jumping connections to the heating fiber.

* * * * *